United States Patent [19]

Payne

[11] 4,167,326

[45] Sep. 11, 1979

[54] CONTACT ELECTROSTATIC PHOTOCOPYING PROCESS AND APPARATUS FORMING REVERSED IMAGE MASTER USING WEB-TYPE PHOTOCONDUCTIVE SURFACE

[76] Inventor: John M. Payne, 13 Crowson Crescent, Northborough, Peterborough, England

[21] Appl. No.: 865,769

[22] Filed: Dec. 29, 1977

[30] Foreign Application Priority Data

Jan. 5, 1977 [GB] United Kingdom ..... 00143/77

[51] Int. Cl.[2] ..... G03G 15/22

[52] U.S. Cl. ..... 355/16; 96/1 TE; 96/1.3; 355/12; 355/64

[58] Field of Search ..... 96/1.0, 1.4, 1 SD, 1.3; 355/12, 3 TE, 16, 64

[56] References Cited

U.S. PATENT DOCUMENTS

| | | | |
|---|---|---|---|
| 3,575,506 | 4/1971 | Knechtel | 355/16 |
| 3,639,049 | 2/1972 | Rhodes et al. | 355/12 |
| 3,972,714 | 8/1976 | Weber et al. | 355/3 TE |

*Primary Examiner*—John D. Welsh

*Attorney, Agent, or Firm*—Allison C. Collard; Thomas M. Galgano

[57] ABSTRACT

A method and apparatus is described by which photocopies can be obtained from documents and the like without the need for optical means for forming focused images of the documents.

Essentially the process involves electrically charging a surface and subsequently applying thereto the document which is to be copied and exposing the document or the rear of the surface to light so as to cause the printed content of the document to form an electrical charge pattern on the surface by producing differential discharge of the electrical charge on the surface due to the contrasting regions in the printing on the document, and subsequently applying printing medium (toner) to the surface to cause it to adhere to the charged regions thereof and fixing the toner in place to form a reversed image master and then reprocessing the master in contact with a sheet of paper or other material the surface of which is photo-receptive by virtue of a layer of zinc oxide or the like which surface has first been electrically charged and exposing the master to light while doing so, so that an electrical charge pattern/image corresponding to content of the original document is formed on the surface of the sheet of paper to which toner can be applied and fixed to form thereon a photocopy of the document content.

18 Claims, 2 Drawing Figures

Figure 1:
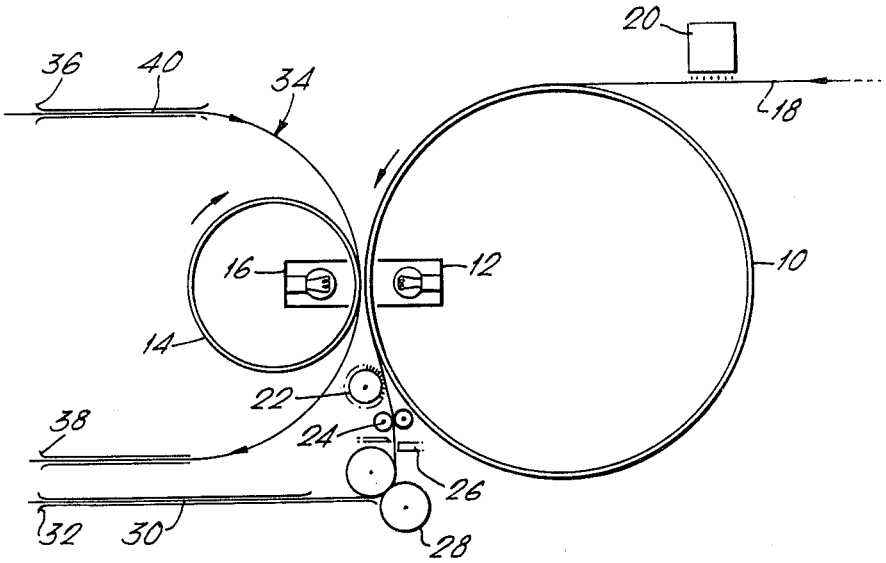

CONTACT ELECTROSTATIC PHOTOCOPYING PROCESS AND APPARATUS FORMING REVERSED IMAGE MASTER USING WEB-TYPE PHOTOCONDUCTIVE SURFACE

FIELD OF INVENTION

This invention concerns electrostatic copying and in particular relates to an improved method and apparatus by which photocopies of printed or similar documents can be obtained using sensitized paper.

BACKGROUND TO THE INVENTION

It is known that if a sensitized paper (for example a paper coated with zinc oxide) is subjected to an electrical charge the impregnation of the paper by the zinc oxide will allow the paper to retain the charge uniformly over the surface of the paper. However the charge is dissipated on exposing the paper to light and this fact is used in building up an electrostatic image of a document which has to be copied by exposing the charged sensitized paper to an image of the document so that the charge is dissipated in those regions of the image which are light and is not dissipated or only partially dissipated in those regions which are dark or partially dark. The electrostatic charge pattern is used to attract to the paper in those places where the charge remains, carbon black or minute granules of ink and the print is obtained by fixing the carbon black or ink onto the paper by partially impregnating the paper with the carbon black or ink typically by passing the paper bearing the printing medium between rollers.

Whilst some documents can be copied by projecting light through the document from the front to the back so as to form a correct image of the document on the surface of the sensitized paper, the majority of documents cannot be used in this way to produce a correct image of the printing or other information carried by the document usually because the document is either too thick or more commonly, there is printing or other information bearing indicia on both sides of the document and if the latter were illuminated images of the printing or other information contained on both sides of the document will be obtained superimposed one on the other on the surface of the sensitized paper and the result is useless.

OBJECT OF THE INVENTION

It is an object of the invention to provide a method and apparatus for photocopying documents which does not require optical systems for forming large full size reversed images of the original document and which are therefore appropriate to portable equipment.

THE INVENTION

A method of obtaining an electrostatic copy of a printed document according to the invention comprises charging electrically a sheet of sensitized paper, bringing the paper into contact with the document with the charged sensitized surface of the paper in contact with the printed face of the document, illuminating the rear surface of the sensitized paper so as to at least partially dissipate the electrical charge on the sensitized surface of the paper except in those regions thereof which are in juxtaposition with the printing on the document, removing the illumination, detaching the document from the now partly discharged sensitized paper, applying a printing medium to the surface of the partly charged sensitized paper so that the printing medium adheres to those regions of the sensitized paper which still retain the electrical charge, fixing the adhering printing medium on the sensitized paper without disturbing the adhering printing medium so as to produce a reversed print of the document, electrostatically charging a fresh piece of sensitized paper and bringing the charged sensitized surface thereof into contact with the sensitized surface of the first mentioned sheet now comprising the print, illuminating the print from the rear so as to project an image of the printing contained thereon onto the charged surface of the fresh piece of sensitized paper, removing the source of illumination and the said print and processing the now partly discharged fresh piece of sensitized paper in the manner previously described for the first piece of sensitized paper, so as to produce a print therefrom.

Conveniently the printing medium is fixed by rolling between rollers or forming a quick drying transparent film over the sensitized surface.

The printing medium may be carbon black or microencapsulated ink.

It will be seen that by adopting this method, a reversed print is first of all obtained by the so-called reflex method and this print is then used in a projection process to obtain a correct print of the original document on a fresh piece of sensitized paper.

The advantage of the method is that no special intermediate paper or plate is required and if two or more copies of a document are required, these can be obtained simply by repeating the projection step and subsequent processing of further sheets of charged sensitized paper using the original print obtained from the first exposure of charged sensitized paper in the reflex mode, to the original document.

It will be seen that the invention will allow copies to be made from a document such as the page of a book which contains printing or other markings on both sides since in the reflex mode, only the printing on the face of the document which is in contact with the charged surface of the piece of sensitized paper produces the charge pattern on the sensitized paper surface.

Apparatus by which the invention can be performed comprises a first drum of translucent material, a first light source located therewithin, a second drum also of translucent material and located so as to form a nip with the first drum, a second light source within the second drum, means for charging a sheet of sensitized paper, means causing the charged sensitized paper to be wrapped around the first drum with the charged surface outermost, means for causing the document which is to be copied to be partially wrapped around the second drum so that the leading edge of the document and the sheet of sensitized and charged paper are introduced simultaneously into the nip, means for causing the first light source to operate as the charged sensitized sheet of paper is drawn through the nip in contact with the document to be copied so as to produce by reflex action an electrical charge pattern corresponding to the printing on the document, on the surface of the sensitized sheet of paper, means for applying to the partly charged surface of the sheet of sensitized paper a printing medium such as carbon black or microencapsulated ink so as to cause the printing medium to adhere to those regions of the surface of the sheet of sensitized paper which are still charged, means for fixing the printing medium in position to produce a permanent print, means for causing the print so produced to be partially wrapped around the said second cylinder with the rear (unsensitized) surface of the print in contact with the said second cylinder, means for charging the sensitized surface of a second piece of sensitized paper, means for introducing the leading edge of both the print and the second piece of charged sensitized paper into the said nip to pass therethrough simultaneously, means for causing the said second light source to operate so as to illuminate the print from the rear and project an image of the printing carried thereby onto the charged sensitized surface of the second piece of sensitized paper so as to produce an electrical charge pattern thereon, and means for feeding the freshly exposed second piece of sensitized paper through the apparatus in the same way as the first piece was processed so as to produce on the second piece of sensitized paper a copy of the printing contained on the original document.

Alternative apparatus for performing the invention comprises a first housing having a light-tight compartment, a roll of sensitized paper within the light-tight compartment, a flat plate on the underside of the housing, means for feeding the sensitized paper from the roll with the sensitized surface outermost and stretching same across the said flat plate formed on the underside of the housing, means for receiving and gripping the sensitized paper beyond the said plate and a light source within the housing operable to illuminate the rear of the sensitized paper, a second housing with which the first housing can cooperate to form a closed container with the sheet of sensitized paper on the said plate sandwiched therebetween, means within the second housing for dusting the sensitive underside of the sensitized paper with a printing medium whereby the latter adheres to those regions of the surface of the sensitized paper stretched over the plate which are charged, a fixing means for fixing the printing medium in place, means for withdrawing the sheet of sensitized paper having printing medium adhering thereto and passing it through the said fixing means so as to produce a print, automatic means causing a fresh piece of sensitized paper to be moved into position and stretched across the said plate in the first housing, means in the said second housing for removably receiving and supporting the aforementioned print, means for illuminating the print from the underside so as to project light therethrough and form an optical image of the print on the surface of the sensitized paper freshly stretched across the said plate in the first housing, and means for charging the sensitized paper in the first housing to an appropriate potential prior to exposing the paper to the image of the document or print so that after such exposure a charge pattern is left forming an electrostatic image of the document.

The first and second housings may be hinged so as to form the base and lid of an attaché-case-like assembly.

Preferably one or other of the two housings incorporates a rim for overlying the junction between the said first and second housings to ensure that the single assembly formed when the first and second housings are brought into contact is light-tight.

Preferably means is provided along one edge of the first housing typically in the form of a serrated edge or guillotine whereby a sheet of sensitized paper which has been processed can be torn or guillotined from the remainder of the roll of sensitized paper.

Preferably means is provided for keeping the first and second housings apart but which allows the two to be pushed into contact thereby to bring into contact the charged surface of the sensitized paper stretched across the plate in the first housing with the document or print located in the second housing or to bring the said sensitized surface into contact with the means for depositing thereon printing medium after the sensitized surface has been exposed to an image.

The invention will now be described by way of example with reference to the accompanying drawings.

In the drawings

Figure 2:
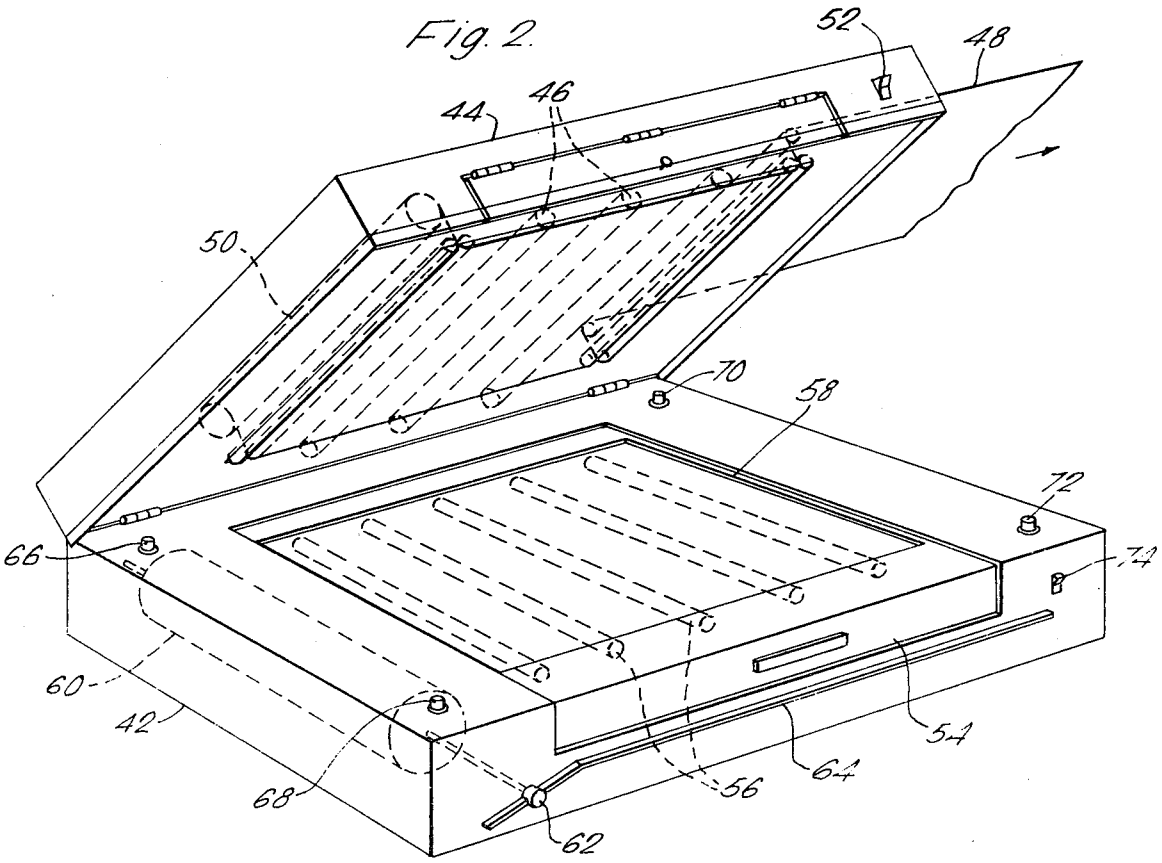

FIG. 1 is a diagrammatic view of one embodiment of apparatus for performing the invention and FIG. 2 is a perspective view of a second embodiment of apparatus for performing the invention.

DESCRIPTION OF APPARATUS SHOWN IN FIG. 1 AND METHOD ASSOCIATED THEREWITH.

As shown in FIG. 1 apparatus for producing a photocopy of an original using an intermediate copy to overcome reversal of image comprises a first drum of translucent material 10 having located therein a light source 12 for illuminating that section of the drum 10 which is opposite to and forms a nip with a second roller 14 having a second light source 15 located therewithin. The second light source 16 is similar to the light source 12 inso far as it illuminates the corresponding section of the drum 14.

A paper feed path generally designated 18 allows sensitized paper such as plain paper impregnated with zinc oxide on one surface, to be conveyed below a charging device 20 for imparting an electrostatic charge to the sensitized surface of the sensitized paper in the path 18, after which the paper wraps around the first drum 10 to pass between the nip formed by the two drums 10 and 14. Beyond the nip the sensitized paper passes a brush 22 which operates to pick up printing medium such as carbon black or microencapsulated ink and to deposit the latter on the surface of the sensitized paper as the latter leaves the drum 10.

The sensitized paper will pick up and hold printing medium in those regions in which there is a residual charge (these regions corresponding to the dark regions of the printing or other similar matter on the document which is to be copied). The printing medium is fixed in position by means of a pair of polished rollers 24 forming a second nip.

After passing between the second nip formed by the rollers 24, the paper passes a guillotine 26 and is then fed in between a further pair of rollers 28 forming a third nip and the paper path then continues via a flat guide 30 to an exit 32.

Although not shown the flat guide 30 incorporates paper feeding means to cause sensitized paper which has passed through the third nip formed by the rollers 28 to be fed along the guide 30 and out of the exit 32.

The second roller 14 constitutes part of a second paper feed path generally designated 34 which extends between an inlet 36 and a second exit 38. This path is for the document to be copied which must therefore be in the form of a flexible sheet and this latter is fed via the flat guide 40 and further guide means (not shown) into the nip between the two drums 10 and 14 so that the printed face which is to be copied is in contact with the charged surface of the sensitized paper on the path 18. Together the original document on the path 34 and the sensitized paper on the path 18 process through the nip between the drums 10 and 14.

As the document passes through the nip, the first light source 12 is operated so as to illuminate the rear of the sensitized paper and cause the uniform electric charge on the face in contact with the document to become dissipated in those areas of the sensitized paper which are strongly illuminated by virtue of their not being in juxtaposition with printing or dark matter on the document. Those regions of the sensitized paper which are in juxtaposition with the printing on the document, are not discharged or are only discharged to a lesser degree and consequently an electrostatic charge pattern is developed on the sensitized paper as it passes through the nip.

Printing medium deposited on the sensitized paper by the brush 22 adheres to those regions which still retain charge and a reversed optical image of the document is thereby obtained. This image is fixed in position by the pair of polished rollers 24.

The guillotine 26 operates after a length of the sensitized paper has been pulled through the apparatus sufficient in length to cause the exposed region of the sensitized paper to be fully to the left of the guillotine 26 as shown in FIG. 1.

As the sensitized paper has moved around the path 18 and the drum 10, so the original document has moved around the path 34 and will be picked up by document drive means (not shown) below the nip formed by the two drums 10 and 14 and will appear at the exit 38.

In operation, after the first print has been obtained in the exit 32, this print is inserted once again into the aparatus this time in inlet 36 with the sensitized face uppermost as shown in FIG. 1. In this way the sensitized face bearing the printing albeit reversed, replaces the original document and traverses around the path 34 in place of the original document. In the same way as before, the print traverses the nip between the drums 10 and 14 sandwiched between the two drums and tightly in contact with the charged surface of the sensitized paper around the drum 10. In this mode of operation however the second source of light 16 serves to project an image of the printing on the sensitized surface of the print or photocopy which has been inserted into the apparatus onto the charged sensitized surface of the paper on the path 18 around the drum 10 and subsequent processing of this sensitized paper produces a correct image of the printing on the original document.

Subsequent passes of the same print through the apparatus will produce identical prints.

DESCRIPTION OF APPARATUS ILLUSTRATED IN FIG. 2.

The second embodiment shown in FIG. 2 comprises an attache-case-like structure comprising a base 42 and a lid 44. The two parts are hinged along the rear edge by means of hinges of the expanding type so that a degree of movement is possible between the two sections 42 and 44 relative one to the other.

The lid forms a first housing for one or more lights typically of fluorescent tube 46 which are located behind a translucent plate (not shown) which forms a flat surface over which sensitized paper 48 from a roll 50 is stretched. The roll 50 is contained in a light-tight chamber (not shown) at the left hand end of the lid 44 and the paper passes between a first pair of rollers forming a first nip (not shown) before leaving the lid 44 and being stretched over the flat surface at the right hand end of which is located a second pair of nip rollers which define an entrance for the paper back into the lid 44. Guides within the lid 44 (not shown) serve to guide the paper 48 through an exit slit (not visible in FIG. 2) in the right hand end of the lid 44.

Although not shown, adjacent the exit slit is a sharpened serrated edge or a guillotine or like device for enabling the protruding end of the sensitized paper 48 to be neatly torn or cut from the remainder of the sensitized paper within the lid.

A switch 52 is provided for controlling the operation of the lights 46.

The base 42 comprises a housing for two basic parts. The first is a detachable slidable tray 54 which can be removed from the base by sliding in a forward direction. The tray comprises a housing for a second set of lights (typically fluorescent tubes) 56 which are visible below a window generally designated 58.

The window 58 is commensurate with the size of document which is to be copied and provides a support for a document or an intermediate print (as will hereinafter be described).

Also within the base 42 is located a roller brush shown in dotted outline at 60. This is carried on an axle which carries at least one toothed wheel which runs on a complementary track so that as the roller is pushed in a sideways direction, the axle and therefore the brush mounted thereon are caused to rotate. To this end the brush is mounted on a carriage (not shown) and a handle 62 secured to the carriage protrudes throught a slot 64 formed in the front wall of the base 42. The slot 64 includes an inclined section so that in the extreme left hand position of the brush, the latter is at a lower level within the container 42 than when it is moved towards the right hand end of the container. This allows the brush to drop down below the level of the top of the container 42 for parking at the left hand end. It is to be understood that the brush is not moved laterally whilst the tray 54 is in position.

Cooperating with the roller brush but not shown in the drawing is a reservoir of carbon black or toner powder or microencapsulated ink which is picked up by the brush as it rotates. With the tray 54 removed, the brush can be moved towards the right hand end of the container 42 and in doing so as previously explained, the brush rises by virtue of the inclined section in the slot 64 until the brush is substantially in line with the flat top of the base container 42. At this height, the brush will continue to rotate and move laterally toward the right hand end of the container 42 as the knob 62 is pushed in that direction.

DESCRIPTION OF PHOTOCOPYING METHOD USING APPARATUS SHOWN IN FIG. 2.

In operation, the tray 54 is fitted and a document to be copied is placed thereon with the printed side uppermost.

A length of sensitized paper from the roll 50 is pulled through and stretched across the flat plate (not shown) in the lid 44. The exposed sensitized surface is charged electrically by any convenient means but preferably by means of a piezo electric crystal generator which is most conveniently held in the hand and directed at the sheet of sensitized paper stretched across the lid.

As soon as the paper has been charged, the lid is quickly shut down over the base container 42. The base includes four studs 66, 68, 70 and 72 in its top surface each of which is resiliently deformable into the plane of the top but normally protrudes approximately half an inch above the top of the base 42. By virtue of the extensible joint between the lid 44 and the base 42, the former will rest equally on the four studs 66 to 72 and in this position, the charged sensitized paper stretched over the flat surface in the lid 44 is kept a short distance away from the document laid on the glass plate 58.

The lid 44 is then depressed evenly so as to bring the stretched charged sensitized paper into contact with the document and simultaneously the fluorescent tubes 46 are operated by switching on switch 52. This conveys electric current to the fluorescent tubes 46 and illuminates the charged sensitive paper from the rear. Those regions of the paper which are in juxtaposition with printing on the document laid on the glass plate 58 do not become discharged but all other regions of the sensitized paper become discharged and an electrical charge pattern results.

The fluorescent tubes 46 are extinguished and the lid allowed to rise under the resilience of the studs 66 to 72. This takes the sheet of sensitized paper bearing the charge pattern out of contact from the document and allows the tray 54 to be withdrawn bearing the original document with it.

The roller brush 60 can now be brought into play by sliding the knob 62 towards the right hand end of the container 42. As it does so carbon black or toner powder or microencapsulated ink (whatever is in the reservoir) is picked up by the brush and flung against the underside of the stretched sheet of sensitized paper bearing the electrical charge pattern. The powder or toner or microencapsulated ink will adhere to the underside of this paper where the electrical charge pattern permits and after a single traverse of the roller brush 60, the latter is returned to its rest position at the left hand end of the container 42. The sensitized paper 48 can then be pulled through the pairs of nip rollers (not shown) in the lid until the section of the sensitized paper which has been exposed to the document is fully outside the lid whereupon this can be detached from the remainder of the sensitized paper by tearing or guillotining as previously described.

By arranging that the second pair of nip rollers (on the right hand side of the flat plate over which the paper is stretched in the lid 44) are highly polished, and by using appropriate carbon black powder or toner or microencapsulated ink, so the image will be fixed on the surface of the sensitized paper as the latter is pulled between the second pair of nip rollers.

The print so obtained is then trimmed and placed face upwards on the glass plate 58 on the tray 54 which is once again inserted into the base 42.

The freshly exposed section of sensitized paper stretched over the flat surface in the lid 44 is charged electrostatically as previously described and the lid 44 immediately closed down on the base 42. Again depressing the lid 44 until the sensitized paper is brought into contact with the print on the glass plate 58, and then energising the fluorescent tubes 56 in the tray 54 by operating a further switch 74, an image of the print is projected onto the understide of the stretched charged sensitized paper in the lid 44 and a fresh electrical charge pattern results.

This can be developed and printed in exactly the same way as the first one was by allowing the lid 44 to become spaced from the base unit 42 under the action of the spring loaded spigots 66 to 72 respectively, turning off the illumination by operating switch 74 and removing the tray 54 to allow the printing medium such as carbon black etc. to be applied to the underside of the now exposed sensitized paper. After the printing medium has been deposited thereon the latter is pulled through the nip rollers so as to fix the printing medium in place.

The print produced by the first process may be used indefinitely so as to produce any number of identical prints therefrom each one corresponding to the original document which has been photocopied.

ADVANTAGES OF THE FIG. 2 EMBODIMENT AND VARIATIONS POSSIBLE THEREIN.

It will be seen that the advantage of this second embodiment is its profitability and if battery operated fluorescent tubes are used, it will be seen that the unit can be operated anywhere and is not reliant on an electricity supply main as are conventional photocopiers.

The electrical power required for the fluorescent tubes may alternatively comprise a piezo-electric source such as that or the same as that employed for charging the paper and reference is made to co-pending British Patent Application No. 54099/76 for details of a circuit for producing the required electrical power from a mechanically operated piezo-electric crystal powered source.

It is also to be understood that the invention is not limited to the use of a piezo electric crystal voltage generator for producing the electrostatic charge on the sensitized paper (and where appropriate the power for the light tubes) but the method of the invention can be applied to any photocopier process in which the electrostatic charge is generated in any known manner.

I claim:

1. A method of obtaining an electrostatic photo copy of a document comprising the steps of:

(1) charging electrically a sensitized surface, (2) bringing the surface into contact with the document with the charged sensitized surface in contact with one face of the document, (3) illuminating the rear of the sensitized surface so as at least partially to dissipate the electrical charge except in those regions thereof which are in juxtaposition with a darkened region of the one face of the document, (4) removing the illumination, (5) separating the document from the partly discharged sensitized surface, (6) applying a printing medium to the partly discharged sensitized surface so that the printing medium adheres to those regions of the sensitized surface which still retain electrical charge and forming a reversed fixed photocopy of the contacted document, (7) electrostatically charging a fresh area of sensitized surface and bringing it into contact with the reversed fixed photocopy.

(8) illuminating the reversed fixed photocopy from the rear so as to project an image thereof onto the charged surface of the said fresh area, (9) removing the illumination and the reversed fixed photocopy, and

(10) processing the now partly discharged said fresh area in the manner as set out in steps (1) to (7) above, so as to produce the electrostatic photocopy.

2. A method as set forth in claim 1 characterised by the step of passing the sensitized surface having printing medium adhering thereto beneath a roller to fix the printing medium on the surface of the paper.

3. A method as set forth in claim 1 characterised by the step of forming a quick drying transparent film over the sensitized surface to fix the adhering printing medium thereon.

4. A method as set forth in claim 1 characterised in that the printing medium is selected from the group of carbon black and microencapsulated ink.

5. Apparatus for performing electrostatic copying of a printed document comprising, in combination:

(1) a first drum of translucent material,
(2) a first light source located within the first drum,
(3) a second drum also of translucent material and located so as to form a nip with the first drum,
(4) a second light source within the second drum,
(5) means for charging a sheet of sensitized paper,
(6) means causing the charged sensitized paper to be wrapped around the first drum with the charged surface outermost,
(7) means for causing the document which is to be copied to be partially wrapped around the second drum so that the leading edge of the document and the sheet of sensitized and charged paper are introduced simultaneously into the nip,
(8) means for causing the first light source to operate as the charged sheet of sensitized paper is drawn through the nip in contact with the document to be copied so as to produce by reflex action an electrical charge pattern corresponding to the printing on the document on the surface of the sensitized sheet of paper,
(9) means for applying to the partly charged surface of the sheet of sensitized paper resulting from the exposure, a printing medium such as carbon black or microencapsulated ink so as to cause the printing medium to adhere to those regions of the surface of the sheet of sensitized paper which are still charged,
(10) means for fixing the printing medium in position to produce a permanent print,
(11) means for causing the print so produced to be partially wrapped around the said second cylinder with the rear (unsensitized) surface of the print in contact with the said second cylinder,
(12) means for charging the sensitized surface of a second piece of sensitized paper,
(13 ) means for introducing the leading edge of both the print and the second piece of charged sensitized paper into the said nip to pass therethrough simultaneously,
(14) means for causing the said second light source to operate so as to illuminate the print from the rear and project an image of the printing carried thereby onto the charged sensitized surface of the second piece of sensitized paper so as to produce an electrical charge pattern thereon and
(15) means for feeding the freshly exposed piece of sensitized paper through the apparatus in the same way as the first piece was processed so as to produce on the second piece of sensitized paper a copy of the printing contained on the original document.

6. Apparatus for performing an electrostatic copying process comprising, in combination:

(1) a first housing having a light-tight compartment,
(2) a roll of sensitized paper within the light-tight compartment,
(3) a flat plate on the underside of the housing,
(4) means for feeding the sensitized paper from the roll with the sensitized surface outermost and stretching same across the said flat plate formed on the underside of the housing,
(5) means for receiving and gripping the sensitized paper beyond the said plate,
(6) A first light source within the housing operable to illuminate the rear of the sensitized paper,
(7) a second housing with which the first housing can cooperate to form a closed container with the sheet of sensitized paper on the said plate sandwiched therebetween,
(8) means within the second housing for dusting the sensitive underside of the sensitized paper with a printing medium whereby the latter will adhere to those regions of the surface of the sensitized paper stretched over the plate which are charged,
(9) a fixing means for fixing the printing medium in place,
(10) means for withdrawing the sheet of sensitized paper with printing medium adhering thereto and passing it through the said fixing means so as to produce a print,
(11) automatic means causing a fresh piece of sensitized paper to be moved into position and stretched across the said plate in the first housing,
(12) means in the said second housing for removably receiving and supporting the aforementioned print,
(13) a second light source for illuminating the print from the underside so as to project light therethrough and form an optical image of the print on the surface of the sensitized paper freshly stretched across the said plate in the first housing and
(14) means for charging the sensitized paper in the first housing to an appropriate potential prior to exposing the paper to the illuminated image of the document or print so that after such exposure a charge pattern is left forming an electrostatic image of the document.

7. Apparatus as set forth in claim 6 wherein the first and second housings are hinged and form the base and lid of an attaché-case-like assembly.

8. Apparatus as set forth in claim 6 wherein one of the said first and second housings incorporates a rim for overlying the junction between the said first and second housings to ensure that the single assembly formed when the first and second housings are brought into contact is light-tight.

9. Apparatus as set forth in claim 6 characterised by a cutting edge on the first housing whereby a sheet of sensitized paper which has been processed can be torn from the remainder of the roll of sensitized paper.

10. Apparatus as set forth in claim 6 further comprising resilient means for keeping separate the first and second housings but which will allow the two housings to be pushed into contact thereby to bring into contact during one stage of a photocopying process the charged surface of a sheet of sensitized paper stretched across the plate in the first housing with a document located in the second housing and during another stage of the photocopying process to bring the said sensitized paper surface into contact with the means for depositing thereon printing medium after the sensitized surface has been exposed to an image.

11. Apparatus as set forth in claim 6 wherein the means for illuminating the sensitized paper during one stage of the photocopying process, and a print during another stage of a photocopying process comprise at least one battery operated fluorescent tube.

12. Apparatus as set forth in claim 6 wherein the means for illuminating the sensitized paper during one stage of a photocopying process and a print during another stage of a photocopying process comprises at least one fluorescent tube electric light and a piezo-electric crystal generator for generating electrical charge for causing said tube to fluoresce.

13. Apparatus as set forth in claim 5 wherein the source of electrical energy for charging the sensitized paper prior to exposure comprises a piezo-electrical crystal source of EMF.

14. Apparatus as set forth in claim 13 wherein the piezo-electric crystal source additionally serves to supply power to actuate the light source.

15. Apparatus as set forth in claim 6 wherein the source of electrical energy for charging the sensitized paper prior to exposure comprises a piezo-electric crystal source of EMF.

16. Apparatus as set forth in claim 15 wherein the piezo-electric crystal source additionally serves to supply power to actuate the first and second light sources.

17. Apparatus as set forth in claim 5 wherein a common source of EMF provides electrical energy for charging the sensitized paper prior to exposure and for activating the light sources.

18. Apparatus as set forth in claim 6 wherein a common source of EMF provides electrical energy for charging the sensitized paper prior to exposure and for activating the light sources.

* * * * *

UNITED STATES PATENT OFFICE

CERTIFICATE OF CORRECTION

Patent No. 4,167,326 Dated September 11, 1979

Inventor(~~s~~) JOHN M. PAYNE

It is certified that error appears in the above-identified patent and that said Letters Patent are hereby corrected as shown below:

Column 8, line 13, delete "profitability" and substitute therefor --portability--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*